United States Patent [19]

Ishida et al.

[11] 4,218,874

[45] Aug. 26, 1980

[54] ELECTRONIC METRONOME

[75] Inventors: Shuichi Ishida; Haruzo Yoshikawa; Fumio Morohoshi, all of Tokyo, Japan

[73] Assignee: Kabushiki Kaisha Daini Seikosha, Tokyo, Japan

[21] Appl. No.: 3,090

[22] Filed: Jan. 12, 1979

[30] Foreign Application Priority Data

Jan. 18, 1978 [JP] Japan ..... 53-003914

[51] Int. Cl.[2] ..... G04F 5/02; G10H 5/06

[52] U.S. Cl. ..... 84/484; 84/1.03

[58] Field of Search ..... 58/130 R, 130 A, 130 E; 84/1.03, 464, 484; 340/366 D, 378 R, 384 E

[56] References Cited

U.S. PATENT DOCUMENTS

| | | | |
|---|---|---|---|
| 3,534,649 | 10/1970 | Andersson | 84/484 |
| 4,014,167 | 3/1977 | Hasegawa et al. | 84/1.03 X |
| 4,018,131 | 4/1977 | Cannon | 84/484 |
| 4,090,355 | 5/1978 | Morohoshi | 58/130 E |
| 4,163,409 | 8/1979 | Rumer | 340/706 X |

*Primary Examiner*—Vit W. Miska

*Attorney, Agent, or Firm*—Robert E. Burns; Emmanuel J. Lobato; Bruce L. Adams

[57] ABSTRACT

An electronic metronome has a visual indicator, a loudspeaker, and a duty time setting circuit for setting the visual time of a visual indicator corresponding to each speed of various tempos. Accordingly, it is easy for a singer, a player, etc. to precisely see the predetermined tempo by using the duty time setting circuit.

5 Claims, 3 Drawing Figures

ELECTRONIC METRONOME

BACKGROUND OF THE INVENTION

This present invention relates to an electronic metronome and more particularly to a metronome having a visual and/or audio displaying device.

Conventional visual tempo-displaying devices, i.e., metronomes, display tempos with a lamp turning on and off in correspondence with a tempo signal generated from a tempo signal generator. In this conventional metronome, the tempo signal applied to the lamp of the metronome is produced by differentiating the tempo signal generated from the tempo signal generator by means of a differential cirucit. As the differential circuit has a predetermined time constant, the output signal rise time of the tempo signal generated from the differential circuit is constant irrespective of the various frequencies of the tempo signals. Generally, a music tempo if 40 to 208 beats per minute, the periods of which are 1.5 to 0.288 second .Accordingly, if the time constant of the differential circuit is determined with respect to the tempo signal of 208 beats per minute so that it is easy to see the flash of light of the tempo signal and if the same time constant is also used with respect to the tempo signal of 40 beats per minute, the duty time of the lower tempo signal (40 beats per minute) differentiated by the differential circuit is very small in comparison with that of the higher tempo signal (208 beats per minute). It will be noted that the duty time is the proportion of the pulse signal rise time to its fall time of the tempo signal. As the result, a output signal rise time of the tempo signal (40 beats per minute) is too short to display the tempo signal with the light turning on and off because the on-time of the light is very short, and so, it is difficult that a singer, a musical instrument player, etc. precisely see the tempo signal.

On the other hand, in the condition that the time constant of the differential circuit and the duty time of the tempo signal generated from the differential circuit are determined with respect to the lower tempo signal (40 beats per minute) so that it is easy to see the tempo signal, when the higher tempo signal (208 beats per minute) is applied to the differential circuit of the same time constant, the duty time of the output signal generated from the differential circuit is too long to display the tempo signal with the light, so that it is difficult that the singer, the player, etc. precisely see the tempo signal.

Accordingly, the duty time of the tempo signal generated from the differential circuit is predetermined corresponding to the various tempos considering the ability of a person to precisely see the tempo signal by the flashing of a light.

It had not been known that the electronic metronome has a duty time setting circuit producing the tempo signal having the duty time which is constant irrespective of the various tempo signal.

BRIEF SUMMARY OF THE INVENTION

The principal object of the present invention is to provide an electronic metronome having a duty time setting circuit which sets a duty time of a tempo signal generated from a tempo signal generator whereby the duty time becomes constant with respect to various frequency tempo signals thereby making it easy for a singer, a player, etc. to precisely see the predetermined tempo.

It is another object of this invention to provide a standard sound signal generating circuit which generates easily an output signal of 440 Hz by supplying an output signal (32768 Hz) generated from a quartz oscillator.

DETAILED DESCRIPTION OF THE PREFERRED EMBODIMENTS

Figure 1:
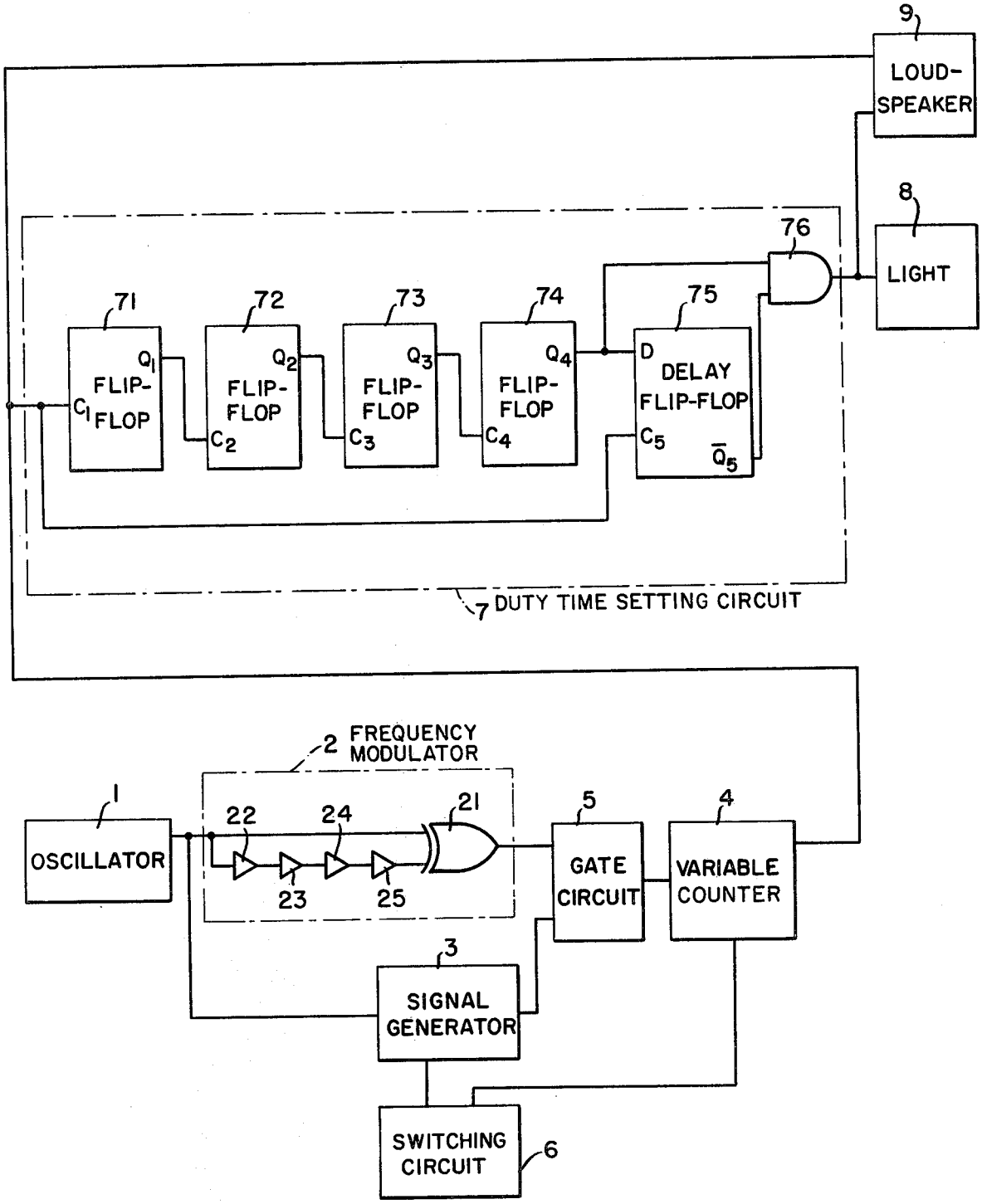
FIG. 1 is a circuit diagram showing an electronic metronome according to the invention.

FIG. 1 is a circuit diagram of an electronic metronome of the invention, in which this electronic metronome comprises a quartz oscillator 1 for generating a standard puise signal of the frequency of 32768 Hz, a frequency multiplier 2 to which the standard pulse signal is applied and which generates a high frequency output signal, the frequency of which is two times as large as that of the standard pulse signal, i.e., the frequency being 65536 Hz, a fundamental tempo signal generator 3 for producing fundamental tempo signals of many kinds of frequencies by synthesizing the standard pulse signal, a variable counter 4 to which the high frequency output signal of the frequency muliplier 2 and the output signals of the fundamental tempo signal generator 3 are alternatively applied through a gate circuit 5, a switching circuit 6 which changes dividing ratios of the fundamental tempo signal generator 3 and the variable counters 4 and whose output signal is applied to the gate circuit 5 to alternatively supply the output signals of the frequency multiplier 2 or the fundamental tempo signal generator 3 to the variable counter 4 through the gate circuit 5, a duty time setting circuit 7 for setting the duty times of many kinds of tempo signals generated from the variable counter 4 at the predetermined ratio, where it will be noted that the duty time is the proportion of the rise time to fall time of the pulse signal, a light 8 to which an output of the duty time setting circuit 7 is applied and which turns on and off in synchronism with the output signal of the variable counter 4, and a loudspeaker 9 to which the output signal of the frequency multiplier 2 is applied through the gate circuit 5 and which produces the standard sound of 440 Hz.

Figure 2:
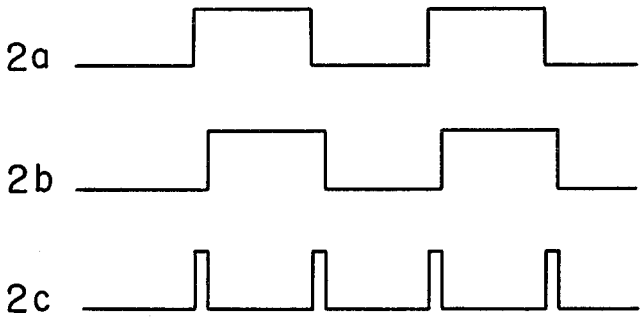
FIG. 2 is a timing graph representing waveforms in a frequency multiplier of the electronic metronome.

In the frequency multiplier 2, the frequency multiplier circuitry comprises an exclusive-OR circuit 21 having a first input terminal to which the standard pulse signal is directly applied and a second input terminal to which the standard pulse signal is applied through NOT circuits 22 to 25 which are connected in series with one another. In this frequency multiplier 2, the standard pulse signal 2*a* (shown in FIG. 2) of the oscillator 1 is applied to the second input terminal through the NOT circuits 22 to 25, so that the output signal 2*b* (shown in FIG. 2), generated from the last NOT circuit 25 which has a predetermined degree of out-of- phase in comparison with the standard pulse signal 2*a* (shown in Fig. 2) is generated from the output terminal of the NOT circuit 25. As a result, the output signal 2*c* (shown in FIG. 2), the frequency of which is two times as large as the standard pulse signal, is generated from the output terminal of the exclusive- OR circuit 21.

The operation of the circuitry for generating the standard sound of 440 Hz is as follows.

The gate circuit 5 is set by the switching circuit 6 so that the standard pulse signal of the oscillator 1 is supplied through the frequency multiplier 2, the gate circuit 5 and the variable counter 4 to the loudspeaker 9 and, simultaneously, the variable counter 4 is set by the switching circuit 6 so that its dividing ratio becomes 1/149. In this condition, when the standard pulse signal of the oscillator 1 is applied to the loudspeaker 9 through the frequency multiplier 2, the gate circuit 5 and the variable counter 4, the frequency of the standard pulse signal is multiplied to become two times as large as its frequency (32768 Hz) by the frequency multiplier 2 to thereby become 65536 Hz. And the frequency of 65536 Hz is divided down until its frequency substantially becomes 440 Hz the output signal of which is generated from the loudspeaker 9 whereby a singer, a player, etc. wanting to hear the sound of 440 Hz may be able to easily hear it.

Next, the operation of the circuitry for selectively displaying many kinds of tempo signals by the light 8 is described hereinafter.

The fondamental tempo signal generator 3 selectively generates many kinds of fundamental tempo signals by operating the switching circuit, and one of the fundamental tempo signal is applied to the variable counter 4 through the gate circuit 5. This variable counter 4 divides down the many kinds of the fundamental tempo signals, so that one of many kinds of tempo signals, for example, 40 beats per minute - 208 beats per minute (the number of tempo beats per one minute) is generated from the variable counter 4 in correspondence with the operation of the switching circuit 6 which changes the dividing ratio of the variable counter 4.

Figure 3:
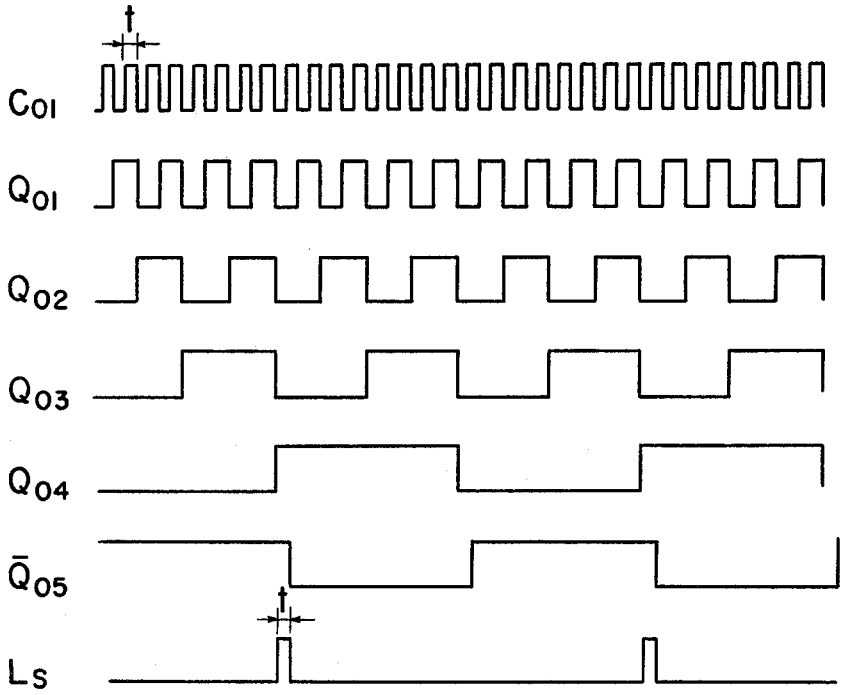
FIG. 3 is a timing graph representing wave forms in the electronic metronome of FIG. 1.

The duty time setting ciruit 7 comprises flip-flop circuit 71 to 74 dividing down the frequency of the output signal supplied from the variable counter 4 in order, a delay flip-flop circuit 75 and an AND gate circuit 76. The tempo signal $C_{01}$, as shown in FIG. 3, supplied from the final output terminal of the fundamental tempo signal generator 3, is applied to the input terminal $C_1$ of the flip-flop circuit 71 and the input terminal $C_5$ of the delay flip-flop circuit 75. The tempo signal $C_{01}$ is applied to the input terminals of the flip-flop circuits 71–74 in order and the output pulse signals $Q_{01}$–$Q_{04}$ as shown in FIG. 3 are generated from the output terminals Q1 to Q4 of the flip-flop circuits 71 to 74, respectively. The output pulse signal $Q_{01}$ generated from the output terminal $Q_1$ of the flip-flop circuit 74 is applied to one of the input terminals of the AND gate circuit 76 and an input terminal D of the delay flip-flop circuit 75, respectively. An output pulse signal $\overline{Q}_{05}$ shown in FIG. 3 is generated from the output terminal $\overline{Q}_5$ of the delay flip-flop circuit 75 and the phase of this output pulse $\overline{Q}_{05}$ is delayed for the halt of the period of the tempo signal supplied from the variable counter 4. The output pulse signal $\overline{Q}_{05}$ is applied to the other of the input terminals of the AND gate circuit 76, so that a tempo signal Ls shown in FIG. 3 which is supplied to the input terminal of the light 8, is generated from the output terminal of the AND gate circuit 76. The light 8 is accordingly switched on for each output signal rise time "t" of the tempo signal Ls. As the result, a time which the light 8 is turned on is changed in correspondence with the output signal rise time "t" generated from the variable counter 4. Accordingly, it is easy that a singer, a player, etc. precisely visually see the tempo signal.

The operation of the circuitry for visually displaying the tempo signal of 120 beats per minute is as follows.

The fundamental tempo signal generator 3, the gate circuit 5 and the variable counter 4 are set by the operation of the switching circuit 6 so that the output signal of the frequency 32 Hz is generated from the variable counter 4. The output signal of the frequency 32 Hz is applied to each of the input terminals $C_1$ to $C_4$ of the flip-flop circuit 71 and 74 in order, to thereby become the output signal of the frequency 2 Hz which is generated from the output terminal Q4 of the flip-flop circuit 74. The output signal of the frequency 2 Hz is supplied to one of the input terminals of the AND gate circuit 76 and to the input terminal D of the delay flip-flop circuit 75, respectively. As the frequencies of the output signals applied to the input termianl D and C5 of the delay flip-flop circuit 75 are 2 Hz and 32 Hz, respectively, the output pulse signal rise time "t" of the tempo signal generated from the AND gate circuit 76 is one-thirty-second (1/32) second. The light 8 is thus turned on corresponding to the output pulse signal rise time.

It will be noted that if the tempo signal generated from the AND gate circuit 76 is applied to the loudspeaker 9 as well as the light 8, the tempo signal is audibly displayed and it will be noted that the variable counter 4 is capable of being abbreviated as occasion demands if the frequency of the output signal of the oscillator 1 is very low.

Because flip-flop circuits, gate circuits and other circuits illustrated symbolically are well known to those skilled in the art, detailed showings of such circuits are not given for purposes of clarity. Such circuit details are only incidentally related to the present invention.

What is claimed is:

1. An electronic metronome comprising an oscillator for generating a standard signal, a fundamental tempo signal generator for synthesizing the standard signal to thereby produce the fundamental tempo signal, a duty time setting circuit having flip-flop circuits for dividing the fundamental tempo signal, a delay flip-flop circuit for delaying a predetermined phase of a tempo signal generated from the flip-flop circuits and a gate circuit to which the outputs of the flip-flop circuits and the delay flip-flop circuit are applied for producing an output signal having an output pulse signal rise time corresponding to the pulse rise time of the fundamental tempo signal, and a light for displaying the output signal generated from the gate circuit.

2. An electronic motoronome according to claim 1, wherein said oscillator generates the standard signal, a frequency of which is 32,768 Hz.

3. An electronic metronome according to claim 2, wherein the electronic metronome, further comprises a frequency multiplier which multiplies the frequency of the standard signal generated from the oscillator to become two times as large as its frequency, a variable counter dividing said frequency of the output signal generated from said frequency multiplier and a loudspeaker for producing an audible sound by applying the output signal generated from the variable counter thereto.

4. An electronic metronome according to claim 3, wherein said loudspeaker includes means for producing an audible sound by applying the output signal generated from the duty time setting circuit.

5. An electronic metronome according to claim 3, wherein the frequency of the output signal generated from said frequency multiplier is divided by 149 in said variable counter to thereby become substantially 440 Hz, said loudspeaker including means for producing an audible sound by applying the output signal generated from said variable counter thereto.

* * * * *